US008267574B2

(12) United States Patent
Gingras et al.

(10) Patent No.: US 8,267,574 B2
(45) Date of Patent: Sep. 18, 2012

(54) METHOD FOR PREPARING A CALIBRATED EMULSION

(75) Inventors: Jean-Philippe Gingras, Pau (FR); Philippe A. Tanguy, Outremont (CA); Louis Fradette, Blainville (CA); Eric Jorda, Lyons (FR)

(73) Assignee: Total Raffinage Marketing, Puteaux (FR)

( * ) Notice: Subject to any disclaimer, the term of this patent is extended or adjusted under 35 U.S.C. 154(b) by 1112 days.

(21) Appl. No.: 12/097,632

(22) PCT Filed: Dec. 15, 2006

(86) PCT No.: PCT/FR2006/002757

§ 371 (c)(1),
(2), (4) Date: Jun. 16, 2008

(87) PCT Pub. No.: WO2007/074225

PCT Pub. Date: Jul. 5, 2007

(65) Prior Publication Data

US 2008/0310252 A1 Dec. 18, 2008

(30) Foreign Application Priority Data

Dec. 16, 2005 (FR) ..... 05 12826

(51) Int. Cl.
*B01F 7/22* (2006.01)
*B01F 7/18* (2006.01)

(52) U.S. Cl. ..... 366/298; 366/300; 366/309; 366/299

(58) Field of Classification Search ..... 366/295, 366/296, 298, 299, 300, 309
See application file for complete search history.

(56) References Cited

U.S. PATENT DOCUMENTS

| | | | | |
|---|---|---|---|---|
| 1,384,805 | A | 7/1921 | McSwiney | |
| 1,916,885 | A | 7/1933 | Kirschbraun | |
| 2,928,665 | A * | 3/1960 | Epprecht | 261/87 |
| 3,669,900 | A | 6/1972 | Cummings | |
| 4,190,371 | A * | 2/1980 | Durr et al. | 366/139 |
| 4,197,019 | A * | 4/1980 | Schold | 366/294 |
| 4,403,868 | A | 9/1983 | Kupka | |
| 5,354,504 | A | 10/1994 | Rivas et al. | |
| 5,419,635 | A * | 5/1995 | Schulte et al. | 366/85 |
| 5,611,619 | A * | 3/1997 | Shen | 366/296 |
| 5,835,174 | A * | 11/1998 | Clikeman et al. | 349/86 |
| 6,037,058 | A * | 3/2000 | Clikeman et al. | 428/402.2 |
| 6,431,742 | B2 * | 8/2002 | Mori et al. | 366/171.1 |
| 2003/0225166 | A1 | 12/2003 | Castillo | |
| 2007/0299228 | A1 * | 12/2007 | McNamee et al. | 526/238.23 |
| 2008/0242739 | A1 * | 10/2008 | Kroon et al. | 514/781 |

FOREIGN PATENT DOCUMENTS

| | | | |
|---|---|---|---|
| EP | 0162591 | A | 11/1985 |
| FR | 1383201 | A | 12/1964 |
| GB | 244135 | A | 12/1925 |

* cited by examiner

*Primary Examiner* — Joseph Del Sole
*Assistant Examiner* — Nahida Sultana
(74) *Attorney, Agent, or Firm* — Juan J. Lizarraga

(57) ABSTRACT

The invention concerns a semi-continuous method for preparing an emulsion of droplets of a phase A in a phase B, including the following steps: (i) mixing an amount of phase A and an amount of phase B using a multi-shaft mixing system comprising at least one scraping agitator, so as to obtain a dispersion of phase A in phase B with a volume concentration of phase A higher than 74%; (ii) diluting the dispersion obtained in step (i) by adding an additional amount of phase B, and mixing using said multi-shaft mixing system, so as to obtain an emulsion of droplets of a phase A in a phase B.

22 Claims, 6 Drawing Sheets

METHOD FOR PREPARING A CALIBRATED EMULSION

TECHNICAL FIELD

The present invention concerns a method for preparing a calibrated emulsion, in particular a bitumen emulsion; it also concerns emulsions prepared following this method.

TECHNICAL BACKGROUND

Emulsions consist of immiscible liquid phases stabilized by one or more surfactants. The need to ensure enhanced performance and to extend the fields of application of emulsions requires calibration of their particle size. In the case of emulsified bitumen for example, the improvement in the properties of the emulsion, in particular in the area of road surfacing (ease and safety of use, homogeneity after drying . . . ), necessitates the obtaining of a finer particle size than currently produced by industrial units. By finer particle size is meant a reduction in the mean size of the droplets and in their polydispersity compared with existing methods.

Two methods can be considered to modify the particle size of an emulsion:

1) a change in the physicochemical parameters of the emulsion, 2) a change in the manufacturing process, or emulsifying process.

However, the specific applications of emulsions often restrict modifications related to physicochemical parameters, which means that modification of the emulsifying process remains practically the only possible way to achieve this objective.

Emulsifying methods are generally developed and scaled under turbulence conditions. Prior art emulsification under these conditions led to identifying a size criterion, which relates the mean droplet size with the power dissipated in the mixer. Technological developments in emulsification methods have therefore turned towards maximizing and/or controlling the dissipated power in mixture geometries. Typically, locally dissipated power varies between $10^4$ W/m$^3$ and $10^7$ W/m$^3$ and the peripheral speed of the impeller is greater than 10 m/s. According to the above-described approach, the success of this objective to control and reduce particle size relies on the design of better performing equipment (high speed rotating parts on geometries provided with a gap of generally less than 1 mm). Said design generates major mechanical complications that are even greater on industrial units. Additionally, this intensification in dissipated power is often accompanied by a major decrease in the residence time in the shear zone, thereby aggravating phenomena of re-coalescence of the droplets and limiting the expected effect of dissipated power on the mean droplet diameter. This is why conventional emulsification methods available on an industrial scale remain largely unsatisfactory.

Also, it is to be noted that the production of high disperse phase emulsions (i.e. with an internal phase of more than around 70%) generally has recourse to specific techniques.

As an example of a method of emulsification in high concentration conditions, document GB 1283462 proposes a system for the continuous production of an oil-in-water emulsion, comprising a rotating beater of planetary type, and in which the phases to be emulsified and the formed emulsion are respectively added and withdrawn continuously.

Document U.S. Pat. No. 3,565,817 gives another example of a method for the continuous production of a concentrated emulsion, in which shearing must be maintained at a sufficient value to reduce the viscosity of the emulsion, but at less than the instability point of the emulsion.

Documents EP 0156486 and EP 0162591 describe methods for preparing concentrated emulsions, at a shear rate of between 10 and 1000 s$^{-1}$, but which, in practice, only allow droplets to be obtained having a typical size of 2 μm to 50 μm.

Document U.S. Pat. No. 4,746,460 describes a method for preparing a concentrated emulsion produced from a foam obtained by beating an aqueous solution with a gas.

Document U.S. Pat. No. 5,250,576 describes a more particular application of a method for preparing concentrated emulsions in which the emulsion is stabilized by cross-linking polymers.

In document U.S. Pat. No. 5,399,293 a concentrated emulsion is continuously formed by subjecting the liquid to two separate, successive shear forces with a single shaft mixer. However, it appears in the examples that the system does not allow droplets of a size of less than 3 μm to be obtained.

Document U.S. Pat. No. 5,539,021 presents another method for preparing a concentrated emulsion, in which the important parameter is the adjustment of the respective flow rates of the two phases to be emulsified, which are continuously mixed.

Document U.S. Pat. No. 5,827,909 describes a continuous method for preparing an emulsion, in which part of the emulsion is withdrawn from the mixing area then re-injected into the mixing area. This method is more particularly dedicated to emulsions intended to undergo subsequent polymerization.

Document WO 99/06139 proposes mixing a first viscous phase to be emulsified (having a viscosity of between 1 and 5000 Pa·s) with a second phase non-miscible with the first one, at a proportion of 75 to 90 wt. % of first phase and a shear rate of between 250 and 2500 s$^{-1}$. The method described in this document is discontinuous i.e. the two phases are brought together at one time.

However, the methods described in the above documents remain difficult to implement. In particular the concentrated emulsions have major instability problems and high risks of phase inversion (i.e. risks of changing from an emulsion of oil-in-water type to an emulsion of water-in-oil type; they also have specific problems related to their non-Newtonian, elastic rheological behaviour.

There is therefore a need to improve known methods, allowing to prepare emulsions in a more reliable and more reproducible manner, with a controlled (and the smallest possible) particle size in terms of mean droplet diameter and polydispersity, in particular on the scale of commercial or industrial production.

SUMMARY OF THE INVENTION

The invention therefore provides a semi-continuous method for preparing an emulsion of droplets of a phase A in a phase B, comprising the following steps:

(i) mixing a quantity of phase A and a quantity of phase B by means of a mixing system with multiple shafts comprising at least one scraper impeller, so as to obtain a dispersion of phase A in phase B at a volume concentration of phase A greater than 74%;

(ii) diluting the dispersion obtained at step (i) by adding an additional quantity of phase B, and mixing with said multiple shaft mixing system so as to obtain an emulsion of droplets of a phase A in a phase B.

Preferably, said mixing system with multiple shafts also comprises at least one non-scraper impeller.

Preferably, in the method of the invention, the mean diameter of the droplets of the emulsion is controlled by adjusting the deformation applied during step (i) mixing.

Preferably, in the method of the invention, the mixing at step (i) is conducted at a deformation rate of between 5 and 150 $s^{-1}$.

According to one particular embodiment of the method of the invention, the mixing system with multiple shafts is coaxial.

Preferably, in the method of the invention, the rotating speed of the scraper impellers undergoes an increase during step (i).

Preferably, in the method of the invention, the scraper impeller(s) are used at a peripheral speed equal to or less than 3 m/s, in particular equal to or less than 2.5 m/s.

Preferably, in the method of the invention, the non-scraper impeller(s) are used at a peripheral speed equal to or less than 15 m/s, in particular equal to or less than 12 m/s during step (i).

Preferably, in the method of the invention, the scraper impellers and non-scraper impellers are able to rotate in co-rotating or counter-rotating mode.

Advantageously, the method such as defined above is such that:

- the mean rotating speed of the scraper impeller(s) is slower during step ii) than during step (i); and
- the mean rotating speed of the non-scraper impeller(s) is faster during step (ii) than during step (i).

According to one more particularly preferred embodiment:

- the rotating speed of the scraper impeller(s) during step (ii) is more than five times slower than the rotating speed of the scraper impeller(s) during step (i); and
- the rotating speed of the non-scraper impeller(s) during step (ii) is more than twice faster than the rotating speed of the non-scraper impeller(s) during step (i).

According to one preferred embodiment of the method of the invention, the mean diameter of the emulsion droplets is less than approximately 1 micron.

According to one preferred embodiment of the method of the invention, the polydispersity of the emulsion is less than 0.4, preferably less than 0.3 and further preferably approximately 0.2

According to one preferred embodiment of the method of the invention, at step (i) phase A is added to phase B at a mass flow rate of between 0.01 time and 3 times the mass of phase B per second.

According to one alternative embodiment, at step (i) phase B is added to phase A at a mass flow rate of between 0.0001 time and 0.1 time the mass of phase A per second.

Preferably, in the method of the invention, phase A is a hydrophilic phase and phase B is a hydrophobic phase, or phase A is a hydrophobic phase and phase B is a hydrophilic phase.

More preferably, phase A is a bitumen and phase B is an aqueous solution, or phase A is an aqueous solution and phase B is a bitumen.

With the present invention it is possible to overcome the drawbacks of the prior art, and more particularly to more reliably and reproducibly prepare emulsions with a controlled (and the smallest possible) particle size in terms of mean droplet diameter and polydispersity, in particular on a commercial or industrial production scale. Also the easy implementation of the present invention on industrial units must be pointed out. The present invention notably allows risks of emulsion inversion to be limited, and can limit the drawbacks related to non-Newtonian and elastic rheological behaviour of the concentrated emulsions.

The purpose of the invention is achieved by using a mixing system with multiple shafts (comprising one or more scraper impellers) to perform mixing under controlled deformation of phase A and phase B, both during the preparation step of the intermediate dispersion with a high phase A concentration, and during the dilution step to achieve the desired end emulsion.

The method of the invention also has advantageous technical differences compared with known methods of preparing highly concentrated emulsions:

- in the method of the invention, the mixing of the two phases is semi-continuous i.e. it is initiated while they are progressively brought into contact, whereas in known techniques either the two phases are placed together at one time and are only mixed thereafter, or the preparation method is of a purely continuous type;
- in the context of the invention, the mixing of the immiscible phases is conducted by means of a mixing system with multiple shafts which comprises one or more scraper impellers and preferably one or more non-scraper impellers, whose respective rotating speeds at each step are predefined, and which can in particular operate in co-rotating mode or counter-rotating mode;
- the method of the invention preferably allows a precise control over the mean droplet diameter using, as sole parameter, the total deformation applied during mixing, said parameter being adjusted in relation to the concentration of the phases using a phenomenological calibration model; on the other hand, in known techniques, this control is made with greater or lesser efficacy via a set of parameters such as the shear rate, the respective concentrations of the phases, the surfactant content and the energy dissipated during mixing, the knowledge of which does not always allow easy prediction of the droplet size.

DETAILED DESCRIPTION OF EMBODIMENTS OF THE INVENTION

Figure 1A:
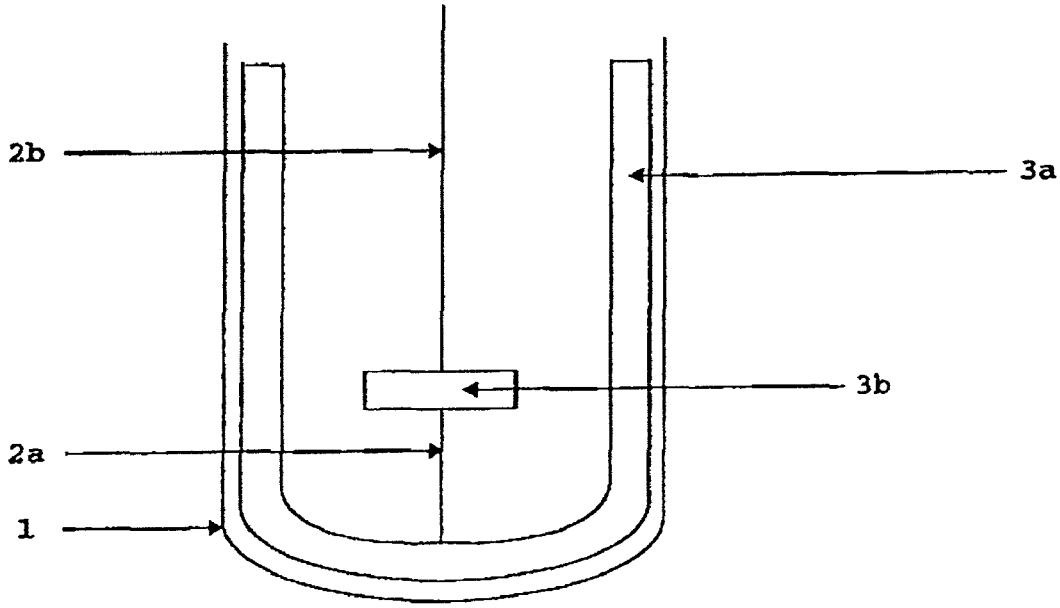
FIGS. 1A to 1D are schematic sectional views showing various mixing systems with multiple shafts which can be used for the invention.

The subject of the invention is therefore a semi-continuous method for preparing an emulsion of droplets of a phase A in a phase B, comprising the following steps:

(i) mixing a quantity of phase A and a quantity of phase B by means of a mixing system with multiple shafts comprising at least one scraper impeller, so as to obtain a dispersion of phase A in phase B with a volume concentration of phase A greater than 74%;

(ii) diluting the dispersion obtained at step (i) by adding an additional quantity of phase B, and mixing by means of said mixing system with multiple shafts, so as to obtain an emulsion of droplets of a phase A in a phase B.

Phases A and B represent two non-miscible liquids able to give rise to an emulsion. Phase A is the phase which is intended to form the droplets or micelles; it is also called the disperse phase. Phase B is the so-called continuous phase, intended to form the interstitial medium between the droplets. Either one of the phases, or both, can contain one or more surfactants. Preferably the surfactants are contained in the continuous B phase.

By "semi-continuous method" is meant that a first part of the products involved in the preparation is initially placed in a recipient used to implement the method, and that a second part of the products is then added during the process itself. Said semi-continuous method differs from a discontinuous method, in which all the products are placed together at one time in the recipient, and differs from a continuous method in which the products involved in the preparation are added continuously and the end product is continuously withdrawn from the recipient, without interruption. Examples of continuous methods are given by the above cited documents GB 1283462, U.S. Pat. No. 5,539,021, U.S. Pat. No. 5,827,909 or U.S. Pat. No. 5,399,293, whilst an example of a discontinuous method is provided by document WO 99/06139. It is to be pointed out that, in discontinuous methods, the mixing of the products can be difficult to carry out and that in continuous methods, which use recipients of smaller volume, difficult rheological problems may arise.

The two steps of the method according to the invention are carried out in a same recipient or vessel.

By "mixing system with multiple shafts" is meant a mixer, which comprises at least two shafts, preferably two to five shafts. On each shaft one or more impellers are mounted. Said mixing system therefore comprises at least two impellers able to rotate independently of each other. Merging shafts are also possible. A mixing system with multiple shafts enables cavities and dead zones to be avoided which are created through inadequate circulation of the fluids, and is fully suitable for mixing fluids whose rheology is complex or changes throughout mixing. Additionally, it has been shown that concentrated emulsions have this type of rheological behaviour. Reference may for example be made to chapter 11, entitled *The structure, Mechanics and Rheology of Concentrated Emulsions and Fluid Foams* by H. M. Princen taken from the Encyclopedic Handbook of Emulsion Technology, by Sjöblom, published by Marcel Dekker (New York, 2001).

The literature of mixing systems with multiple shafts particularly comprises the following:

*Mixing: Theory and Practice*, by Uhl and Gray, published by Academic Press (New York, 1996);

*Mixing in the Process Industries 2nd Edition*, by Hamby, Edwards and Nienow, published by Butterworth Heinemann (Oxford, 1992);

*Fluid Mixing Technology*, by Bates, Fondy, Fenic and Oldshue, published by Chemical Engineering (New York, 1983);

*Handbook of Industrial Mixing: Science and Practice*, by Paul, Atiemo-Obeng and Kresta, published by John Wiley & Sons (New Jersey, 2004).

By "scraper impeller" is meant an impeller, which is characterized by a ratio between the gap and the vessel diameter of between 0 and 0.1, and preferably between 0 and 0.05. The gap is the minimum distance between the peripheral end of the blade (or other rotating part) of an impeller and the wall of the vessel.

The geometry of the scraper impeller generally induces a tangential flow (in particular with an anchor or paddle type impeller). The scraper impeller may also have a geometry, which combines tangential and axial flows (as with an impeller of helical type).

Preferably, at step (i), one phase is gradually added, or gradually incorporated (over a time of at least a few seconds or even at least a few minutes) to the other phase, whilst mixing using a mixing system with multiple shafts. In practice, one of the two phases is initially placed in a recipient such as vessel, then the other phase is poured or injected into the first one (e.g. at the top, bottom or in the middle of the recipient). The mixing of step (i) can be continued until after the incorporation process i.e. even when incorporation is completed. The mixture has sufficient intensity to obtain the desired particle size of the emulsion (in terms of mean size and polydispersity of the droplets).

The quantities of phase A and B intended to be contacted and mixed are such that phase A represents more than 74% by volume of the two phases after step (i). The volume concentration of 74% represents the maximum theoretical stacking of spherical droplets of single size. Beyond this threshold, some droplets or all the droplets lose their spherical shape to assume a polyhedral shape. Therefore the mixture of phases A and B obtained shows high effective viscosity, which makes it possible, even with a low rotating speed of the mixing mechanisms used, to achieve efficient breaking of the droplets down to the desired size.

The dispersion obtained at step (i) is an intermediate emulsion, and the emulsion obtained at step (ii) is the final emulsion. However, the intermediate emulsion itself can advantageously be collected for its use, insofar as it may have satisfactory characteristics for certain specific needs. The final emulsion has the desired disperse phase concentration, which may be less than 74 vol. %, and even as low as desired. The addition of the additional quantity of continuous phase B during step (ii) is preferably gradual and is performed under mixing using the same mixing system as used for step (i). The mixing of step (ii) can be continued after the addition of the additional quantity of phase B has been completed.

The continuous phase B, which is added at step (ii) may contain surfactants. The dilution provided at step (ii) ensures relaxation of the droplets of polyhedral shape (reduction of the interfacial surface area). The added phase B inserts itself between the droplets. During this step a major force is provided to counter the separating pressure, which ensures the stability of the films of concentrated emulsions, hence the importance of carrying out mixing during step (ii).

Preferably, the mixing system may also comprise one or more non-scraper impellers, characterized by a ratio between the gap and the vessel diameter of more than 0.1. For non-scraper impellers, priority is given to the different geometries of impellers with axial and/or radial flow. Mention may be made for example of screws, dispersion discs, turbines with radial or mixed flow.

FIGS. 1A to 1D show a sectional diagram of various mixing systems with multiple shafts, which can be used to implement the method of the present invention.

FIG. 1A shows a mixing system in a vessel or recipient (1) comprising two shafts (2*a*, 2*b*) on a same spindle but which are able to rotate independently of each other. It is a coaxial system. On each shaft (2*a*, 2*b*) a respective impeller (3*a*, 3*b*) is mounted. One of the impellers (3*a*) is a scraper impeller, of anchor type, whilst the other impeller (3*b*) is a non-scraper impeller of dispersion disc, screw or turbine type.

Figure 1B:
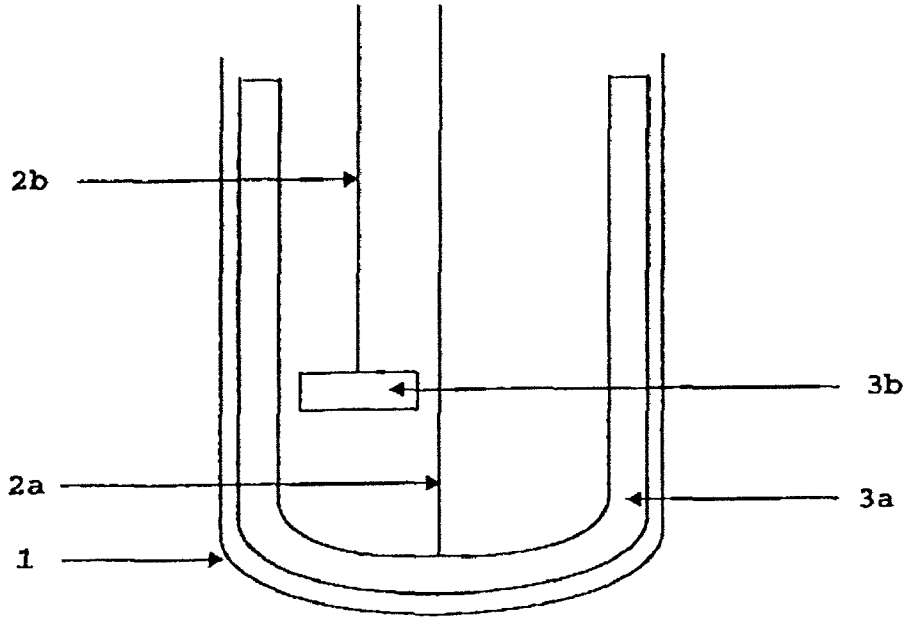

In the mixing system with multiple shafts shown in FIG. 1B, the two shafts (2*a*, 2*b*) are located on two separate, parallel axes. It is a non-coaxial system. The two respective impellers (3*a*, 3*b*) mounted on the two shafts (2*a*, 2*b*) are also of different types, one of scraper type (3*a*) and one of non-scraper type (3*b*).

Figure 1C:
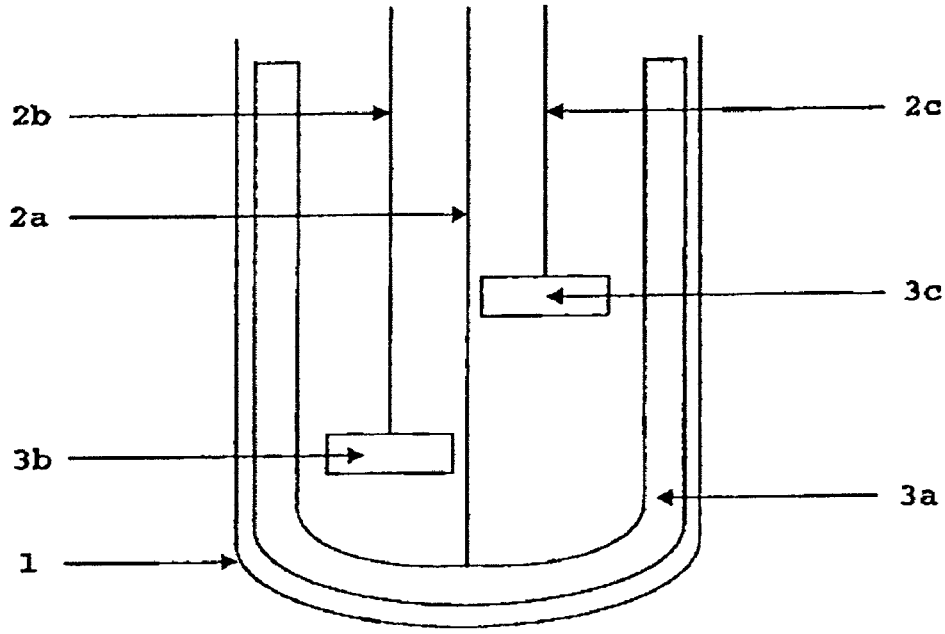

The mixing system shown in FIG. 1C comprises three shafts (2*a*, 2*b*, 2*c*) positioned on three separate, parallel axes and on which three respective impellers are mounted (3*a*, 3*b*, 3*c*) of which one (3*a*) is of scraper type and the other two (3B, 3*c*) are of non-scraper type.

Figure 1D:
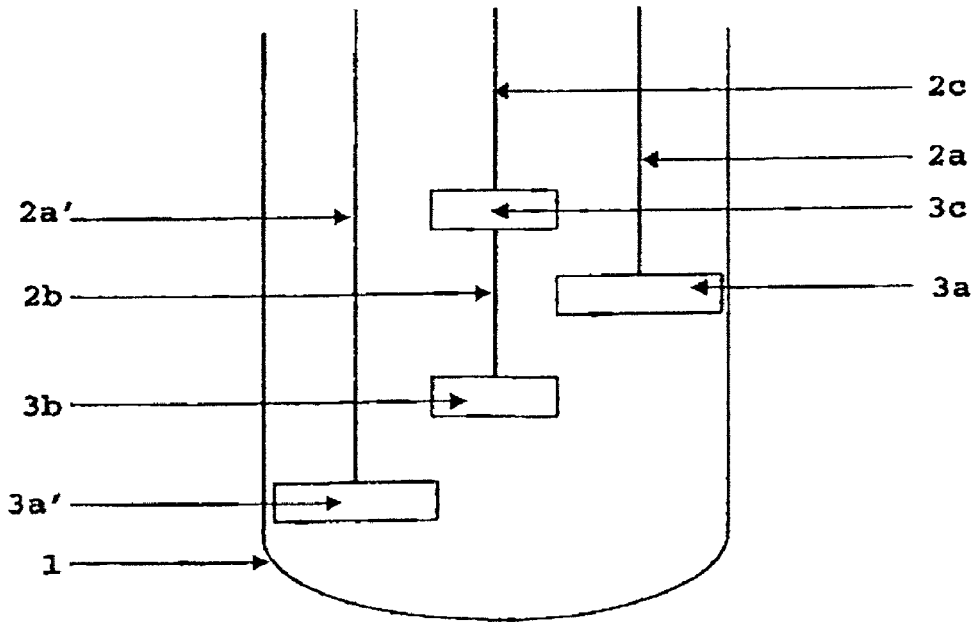

The mixing system shown in FIG. 1D differs from the preceding systems in that it comprises two scraper impellers (3*a*, 3*a*') mounted on two non-coaxial separate shafts (2*a*, 2*a*'). Unlike in the preceding examples, only one part of the periphery of these scraper impellers (and not the entirety) is located in the immediate vicinity of the wall of the vessel (1). In this case, the gap of the scraper impellers (3*a*, 3*a*') corresponds to the minimum distance between the periphery of the impellers and the wall of the vessel. As in the other examples of mixing systems, the ratio between the gap and the diameter of the vessel lies between 0 and 0.1, preferably between 0 and 0.05. The mixing system in FIG. 1D is also equipped with two non-scraper impellers (3*b*, 3*c*) mounted coaxially on respective shafts (2*b*, 2*c*).

It is to be noted that the above devices are only a few examples among very numerous possible geometries for the mixing system with multiple shafts that can be used according to the invention, which are known to those skilled in the art through patents or publications in this field. Therefore, simply to illustrate the diversity of existing mixing systems with multiple shafts, the mixing system of document U.S. Pat. No. 3,861,656 can be cited which comprises a paddle type scraper impeller and, inside the trajectory followed by the scraper impeller, two very close offset screws, which form a coordinated assembly of non-scraper impellers. As an additional illustration, reference may also be made to documents U.S. Pat. No. 4,854,720, U.S. Pat. No. 4,197,019, U.S. Pat. No. 4,403,868, EP 1121193, or U.S. Pat. No. 5,611,619.

Additionally, in the context of the invention, the shaft or shafts carrying the non-scraper impeller(s) are not necessarily vertical and parallel, but may on the contrary be tilted. In particular, it is possible to use a vessel provided with a single scraper impeller in which an auxiliary impeller is installed in oblique position and clamped onto the edge of the vessel.

Preferably, the mean diameter of the droplets of the emulsion is controlled by adjusting the deformation applied during the mixing at step (i) mixing. In fact, as described below (example 4), for a given particular type of mixing system with multiple shafts, it is possible to obtain calibration using a phenomenological approach allowing the mean diameter of the emulsion droplets to be related to the total deformation applied during step (i). Owing to this calibration, it is possible to obtain an emulsion of desired particle size by adjusting the single parameter of total deformation applied during step (i) for a given concentration of the phases.

Preferably, mixing is carried out at a deformation rate of between 5 and 150 $s^{-1}$ at step (i). It is recalled that the deformation rate $\dot{\gamma}$ is related to total deformation $\gamma$ by the equation $\gamma=\dot{\gamma}\,t$ in which t is the residence time in the maximum deformation zone.

In the mixing system with multiple shafts, the shafts can be centred or off-centred relative to the vessel in which the mixture is conducted. According to one particular embodiment, the mixing system is coaxial. It is a configuration comprising at least two centred shafts of which one is preferably provided with a scraper impeller and the other one is preferably provided with a non-scraper impeller. In this case, the ratio between the diameter of the non-scraper impeller and the vessel diameter preferably lies between 0.2 and 0.6, and more particularly between 0.3 and 0.5.

The scraper and non-scraper impellers may rotate in co-rotating or counter-rotating manner i.e. respectively in the same direction or in opposite directions.

During step (i) the scraper impeller(s) have a major role. They are preferably used at a peripheral speed of between 0.05 m/s and 3 m/s. The use of the scraper impeller(s) at these speeds ensures sufficient deformation to cause breaking of the droplets. Preferably, the rotating speed of the scraper impeller (s) undergoes an increase during step (i), which allows product losses to be reduced during step (ii) and the quality of the mixture to be improved during step (i).

One or more non-scraper impellers may also be used during step (i), in which case their role is to improve the spatial distribution of phases A and B in the zones lending themselves to droplet deformation created by the scraper impeller(s). In this case, their mean peripheral speed is typically less than 12 m/s.

Also in this case, the contribution of the non-scraper impeller(s) towards the deformation of the emulsion with high disperse phase is negligible compared with that of the scraper impeller(s). The deformation rate induced by a mixer with multiple shafts is therefore similar to that applied by the scraper impeller(s). However the mean deformation rate created by an impeller is related to the rotating speed N of this impeller (in revolutions per second) under the formula: $\dot{\gamma}=K_s\times N$ in which $K_s$ is a constant which depends on the geometry of the impeller.

Figure 5:
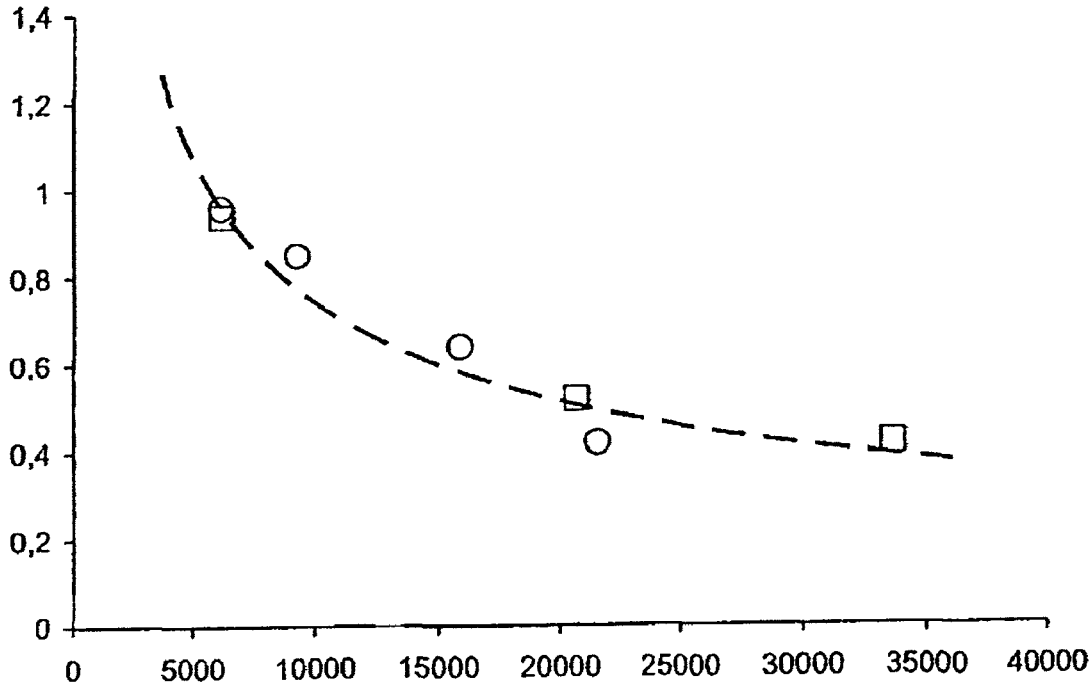
FIG. 5 gives the median diameter of the droplets of a bitumen emulsion in water, obtained using a coaxial mixing system (diameter given in microns along the Y-axis), in relation to the deformation applied to the emulsion (X-axis), itself proportional to mixing time, at a constant deformation rate. □=results obtained for a deformation rate of 85 $s^{-1}$; O=results obtained for a deformation rate of 50 $s^{-1}$. The dotted curve corresponds to a phenomenological model.

Bearing in mind that the $K_s$ of the scraper impeller is known, by adapting the rotation speed of the scraper impeller and the mixing time of the intermediate emulsion, a given deformation is imposed and hence a desired particle size is reached (see FIG. 5 in particular). By way of example, regarding the mixing geometries mentioned above for the scraper impeller, K, generally varies between 15 and 70, preferably between 20 and 45. The maximum power density of the scraper impeller during mixing of the emulsion with high disperse phase lies in a range of 10 to 100 times less than that of impellers operated under turbulence conditions ($10^3$ W/$m^3$ to 10 W/$m^3$).

During step (ii), the pumping and circulation generated by the mixing system maximize relaxation of droplet shape. For this purpose non-scraper impellers are given priority: they are operated over a speed range of 0 to 15 n/s. The scraper impeller(s), which play a major role at this step on account of the tangential flow they induce, can nevertheless advantageously be combined with non-scraper impellers so as to optimize relaxation of the droplets. In this case, the peripheral speed of the scraper impeller(s) is slower than that of the non-scraper impellers and lies between 0 and 2 m/s.

The major role given to the scraper and non-scraper impellers, during the mixing step of the concentrated emulsion and the dilution step respectively, justify that:

- the mean rotating speed of the scraper impeller(s) is lower, and in particular lower by a factor of more than 5, during step (ii) compared with step (i); and
- the mean rotating speed of the non-scraper impeller(s) is greater, in particular by a factor of more than 2, during step (ii) compared with step (i).

It is to be noted that the speed of the non-scraper impeller(s) may be zero during step (i) and nonzero during step (ii), and that the speed of the scraper impeller(s) can be nonzero during step (i) and zero during step (ii).

Preferably, the dispersion obtained after step (i) has a weight fraction of surfactants of between 0.005 and 0.05, although a different weight fraction range could advantageously be used depending on the composition of the emulsion. It is to be noted that a shortage or excess of surfactant could lead to instability of the emulsion (fast coalescence) or to phase inversion. It is also to be pointed out that the weight fraction of surfactant which needs to be used depends on the disperse phase concentration at step (i). Surfactants may or may not be included in continuous phase B which is added during step (ii). The surfactants which can be used for the invention are particularly anionic, cationic, non-ionic and amphoteric surfactants.

Preferably, in the final emulsion the mean size of the droplets is less than approximately 1 micron with a polydispersity of less than 0.4 (or 40%), preferably 0.3 (or 30%), and further preferably approximately 0.2 (or 20%). By "polydispersity" is meant the ratio between the standard deviation of particle size distribution and the mean diameter of the droplets.

Two alternative, advantageous modes are possible to conduct step (i):

according to the first mode, the gradual contacting during step (i) consists in adding phase A to phase B at a mass flow rate of between 0.01 time and 3 times the mass of phase B per second;

according to the second embodiment, the gradual contacting during step (i) consists in adding phase B to phase A at a mass flow rate of between 0.0001 time and 0.1 time the mass of phase A per second.

In the first case, the disperse phase is therefore poured on or injected into the continuous phase, and in the second case it is the continuous phase which is poured on or injected into the disperse phase.

Besides, phase A can be a hydrophilic phase and phase B a hydrophobic (or lipophilic) phase, or else phase A can be a hydrophobic phase and phase B a hydrophilic phase. The term emulsions of 'water-in-oil' type is used for the first case, and emulsions of "oil-in-water" type in the second case. Preferably it is phase A, which is hydrophobic and phase B is hydrophilic.

Each hydrophilic or hydrophobic phase comprises at least one hydrophilic or hydrophobic compound respectively, and can for example comprise a mixture of hydrophilic or hydrophobic compounds respectively, or it may consist of a single hydrophilic or hydrophobic compound respectively.

Examples of possible hydrophilic phases are water and aqueous solutions.

Examples of possible hydrophobic phases are oils, hydrocarbons.

More particularly, among the compounds able to be dispersed according to the invention the following are included:

for hydrophobic materials: colophane esters, lanolin, bitumens, waxes, polybutadienes, and generally hydrophobic or lipophilic polymers, for hydrophilic materials: polyethylene glycols, sugars, gelatines and their mixtures.

The invention can therefore be applied to areas as varied as the food industry, pharmacology, cosmetics and the majority of industrial fields.

In a particularly preferred manner, disperse phase A is a bitumen and continuous phase B is an aqueous solution, or disperse phase A is an aqueous solution and continuous phase B is a bitumen. The calibrated bitumen emulsion thus prepared can be used in the road surfacing industry, in particular to manufacture road mats by laying (and possibly compacting) materials obtained by coating or contacting aggregates, recycled materials, bituminous aggregates (or a mixture of these products) with a bitumen emulsion such as manufactured according to the invention. By "bituminous aggregates" is meant any materials derived from the destruction of bituminous mats, and by recycled materials is meant any type of materials derived from the recovery of industrial waste able to be recycled for the manufacture of road bituminous mix (demolition materials, clinker, blast furnace cinder, tyres . . . ). The emulsions of the invention can also be used for direct spreading in road applications such as non-skid layers, surface coatings or ground impregnation.

Outside the road surfacing industry, the bitumen emulsions of the invention can advantageously be used for sealings and adhesives in the building industry.

One of the phases, or both phases, can be heated before or during the emulsifying process. Therefore for a bitumen emulsion, the bitumen is advantageously brought to a temperature of between 70 and 105° C. in order to fluidize it before mixing, and to ensure a sufficiently high mixing temperature during step (i). The temperature under consideration is dependent upon the penetration grade of the bitumen used and its optional modification by polymers. Generally it may be desirable not to exceed a certain temperature to avoid water evaporation. However, it is also possible to use the method of the invention under pressure, to work with very low-penetration bitumen or polymer-modified bitumen.

According to one particular embodiment, the invention concerns a method for preparing a calibrated bitumen emulsion, comprising the following steps:

(a) adding a quantity of bitumen at a temperature of between 70 and 105° C. to a quantity of aqueous solution containing surfactants at a mass flow rate of between 0.01 time and 3 times the mass of the aqueous solution per second, and simultaneously mixing the bitumen and aqueous solution using a mixing system with multiple shafts, so as to obtain a pre-mixture of aqueous solution and bitumen in which the volume fraction of bitumen is greater than 74%;

(b) additional mixing of the previous pre-mixture by means of the mixing system with multiple shafts, so as to obtain a dispersion of bitumen in the aqueous solution;

(c) gradual adding of an additional quantity of aqueous solution to the previously obtained dispersion, and simultaneously mixing the bitumen dispersion in the aqueous solution by means of the mixing system with multiple shafts, so as to obtain a dilute dispersion of bitumen in the aqueous solution;

(d) additional mixing of the dilute dispersion previously obtained using the mixing system with multiple shafts, so as to obtain the emulsion of bitumen droplets in the aqueous solution;

in which the mixing system with multiple shafts comprises at least one scraper impeller and at least one non-scraper impeller operating in a counter-rotating mode, and produces a deformation rate of between 5 and 150 $s^{-1}$, and in which:

the rotating speed of the scraper impeller(s) is slower during steps (c) and (d) than during steps (a) and (b); and the rotating speed of the non-scraper impeller(s) is greater during steps (c) and (d) than during steps (a) and (b).

According to another particular embodiment, the invention concerns a method for preparing a calibrated bitumen emulsion comprising the following steps:

(a) adding a quantity of aqueous solution containing surfactants to a quantity of bitumen at a temperature of between 70 and 105° C. at a mass flow rate of between 0.0001 time and 0.1 time the mass of aqueous solution per second, and simultaneously mixing the bitumen and aqueous solution using the mixing system with multiple shafts, so as to obtain a pre-mixture of aqueous solution and bitumen, in which the volume fraction of bitumen is greater than 74%;

(b) additional mixing of the previous pre-mixture using the mixing system with multiple shafts, so as to obtain a dispersion of bitumen in the aqueous solution;

(c) gradually adding an additional quantity of aqueous solution to the previously obtained dispersion, and simultaneously mixing the bitumen dispersion in the aqueous solution using the mixing system with multiple shafts, so as to obtain a dilute dispersion of bitumen in the aqueous solution;

(d) additional mixing of the dilute dispersion previously obtained using the mixing system with multiple shafts so as to obtain the emulsion of bitumen droplets in the aqueous solution;

in which the mixing system with multiple shafts comprises at least one scraper impeller and at least one non-scraper impeller operating in counter-rotating mode, and produces a deformation rate of between 5 and 150 $s^{-1}$, and in which:

the rotating speed of the scraper impeller(s) is slower during steps (c) and (d) than during steps (a) and (b); and the rotating speed of the non-scraper impeller(s) is greater during steps (c) and (d) than during steps (a) and (b).

Advantageously, the calibrated bitumen emulsion obtained following one of the preceding methods is characterized by a mean droplet size of less than approximately 1 micron with a polydispersity of less than 0.4.

EXAMPLES

The following examples illustrate the invention without limiting it however.

Example 1

Emulsification of Bitumen Following a Protocol No 1 of Incorporation of Bitumen in Water The emulsion consists of grade PG 64-22 bitumen, water and oxypropylated dipropylene triamine tallow (marketed by CECA under the trade name Polyram SL). The mixing system comprises a scraper impeller, which is a 3-arm anchor. The ratio between the diameter of this impeller and the vessel is 0.99. The mixing system also comprises a non-scraper impeller in the form of a turbine with 6 blades tilted at an angle of 45°. The ratio between the diameter of the turbine with tilted blades and the vessel is 0.33. The ratio between the height of the turbine and the diameter of the vessel is 0.2. The diameter of the vessel is 254 mm.

295 g of hydrophilic phase containing 30 wt. % of surfactant is placed in the vessel whose wall has been pre-heated to 85° C. for approximately 5 minutes before starting to incorporate the bitumen. By means of a gear pump connecting the emulsifying vessel to a bitumen storage vessel, the bitumen is fed into the bottom of the emulsion vessel. The flow rate of the bitumen is kept at 22 g/s for 180 seconds. The temperature of the injected bitumen is 98° C. During incorporation of the bitumen, the anchor speed is increasingly raised from 15 rpm to 60 rpm in the clockwise direction. The turbine is used during incorporation of the bitumen at an average speed of 770 rpm in the counter-clockwise direction. The high disperse phase emulsion thus obtained is mixed at a speed of 90 rpm with the anchor in the clockwise direction for 120 seconds. The turbine is also used to mix the high disperse phase emulsion at an average speed of 770 rpm in the counter-clockwise direction.

Figure 2:
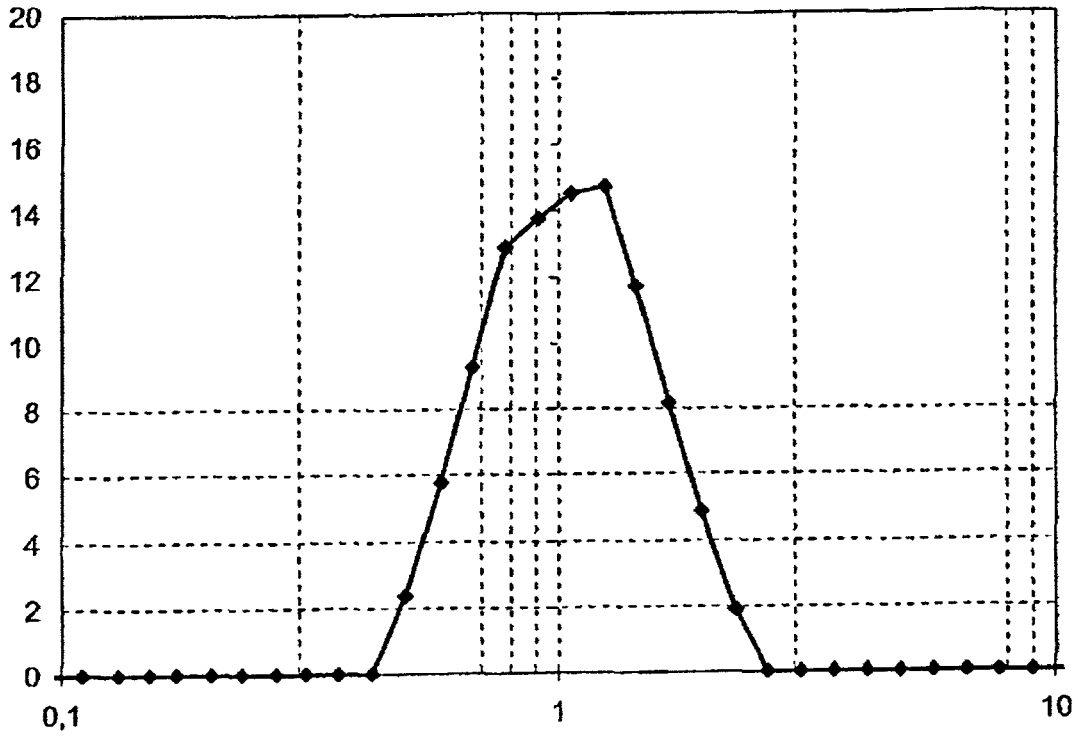
FIGS. 2 to 4 show the particle size profile of bitumen emulsions in water, obtained according to the protocols of examples 1 to 3 respectively. The diameter of the droplets is shown in μm along the X-axis, and the volume percentage is shown along the Y-axis corresponding to the different drop sizes (size distribution profile).

Water is added to the content of the vessel after 300 seconds from the start of bitumen incorporation, and for 50 seconds at a mean flow rate of 33.1 g/s. When the water is incorporated the anchor speed is lowered to 10 rpm in the clockwise direction, and the turbine speed is gradually increased up to 1620 rpm in the counter-clockwise direction. These respective impeller speeds are maintained for 240 seconds to obtain the end product. A small quantity of so-called end product is then taken and diluted in a solution of water and Stabiram MS3 surfactant marketed by CECA. The very dilute emulsion thus obtained is placed in a Mastersizer S (Malvern Instruments) to measure the particle size. The particle size obtained is shown in FIG. 2.

Example 2

Emulsification of Bitumen Following a Protocol No 2 of Incorporation of Water into Bitumen The hydrophilic and hydrophobic phases and the geometry of the coaxial mixing system are similar to those described in example 1.4 kg of bitumen are added to an emulsifying vessel. The bitumen is heated to 95° C. in this same vessel using heating strips located on the walls of the vessel whilst mixing by means of the anchor operating at a speed of 20 rpm in the clockwise direction. When the temperature has stabilized at 95±1° C., the anchor speed is increased to 55 rpm in the clockwise direction. The emulsifying method is started by adding within ten seconds 295 g of a water/surfactant mixture containing 30.5 wt. % surfactant, via the top of the vessel. The turbine is set in operation 25 seconds after the start of emulsification (start of soap injection) at a speed of 760 rpm in the counter-clockwise direction until the water is added. The anchor speed is increased to 70 rpm in the clockwise direction after 60 seconds from the start of emulsification. In the same manner the anchor speed is increased to 90 rpm and 105 rpm in the clockwise direction after 120 seconds and 180 seconds.

Figure 3:
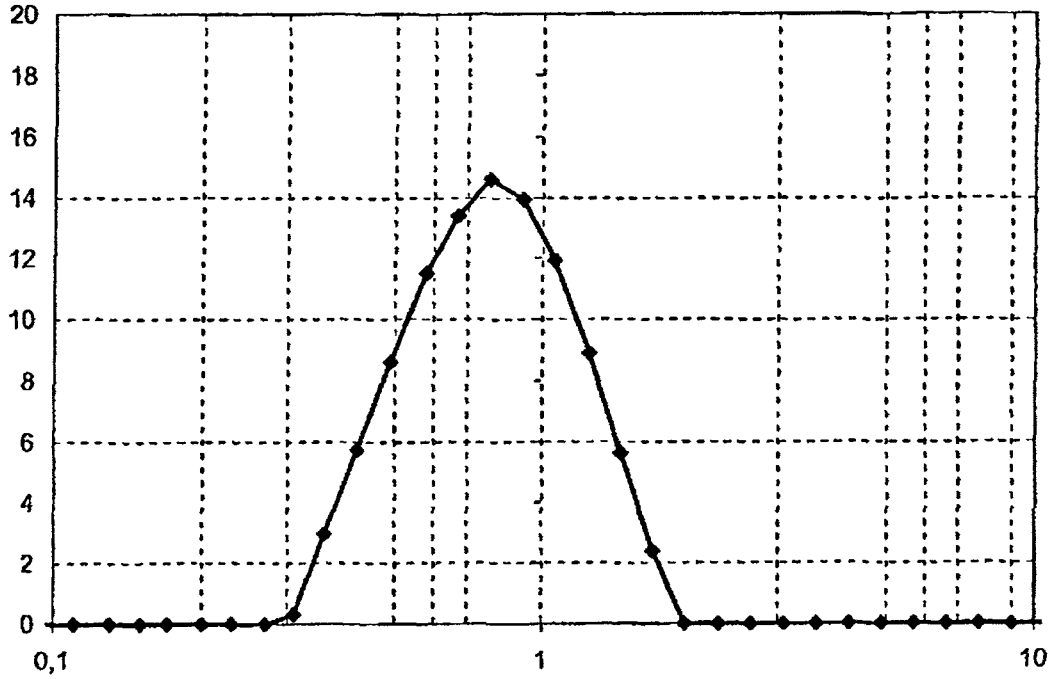

Water is added to the vessel content after 240 seconds after the start of emulsification and for 50 seconds at a mean flow rate of 33.1 g/s. When the water is incorporated the anchor speed is lowered to 10 rpm in the clockwise direction and the turbine speed is gradually increased up to 1600 rpm in the counter-clockwise direction. These respective speeds of the impellers are maintained for 240 seconds to obtain the end product. A small quantity of the so-called end emulsion is then taken and diluted in a solution of water and surfactant (Stabiram MS3 marketed by CECA). The very dilute emulsion obtained is placed in a Mastersizer S (Malvern Instruments) to measure the particle size. The particle size obtained is shown FIG. 3.

Example 3

Emulsification of bitumen according to a second version of protocol No 1 of Incorporation of Bitumen in Water (Other Type of Mixer)

The hydrophilic and hydrophobic phases and the non-scraper impeller of the coaxial mixer are similar to those described for examples 1 and 2. The geometry of the scraper impeller is a double helical ribbon. The height of the ribbon is 254 mm with a pitch of 152 mm and a width of 25.4 mm. The ratio between the diameter of the helical ribbon and the vessel is 0.98. The diameter of the vessel is 254 mm.

295 g of surfactant/water mixture containing 29.5 wt % surfactant are added to the vessel whose wall has been pre-heated to 85° C. for around 5 minutes before starting to incorporate the bitumen. By means of a gear pump, which connects the emulsifying vessel to a bitumen storage vessel, the bitumen is fed to the bottom of the emulsion vessel. The bitumen flow rate is 22 g/s and feeding of the disperse phase is stopped after 180 seconds. The temperature of the injected bitumen is 98° C. During incorporation of the bitumen, the anchor speed is increasingly raised from 15 rpm to 60 rpm in the clockwise direction. The turbine is used during incorporation of the bitumen at an average speed of 670 rpm in the counter-clockwise direction. The high disperse phase emulsion is mixed for 120 seconds at a speed of 90 rpm in the clockwise direction with the anchor. The turbine is also used during mixing of the high disperse phase emulsion at an average speed of 670 rpm in the counter-clockwise direction.

Figure 4:
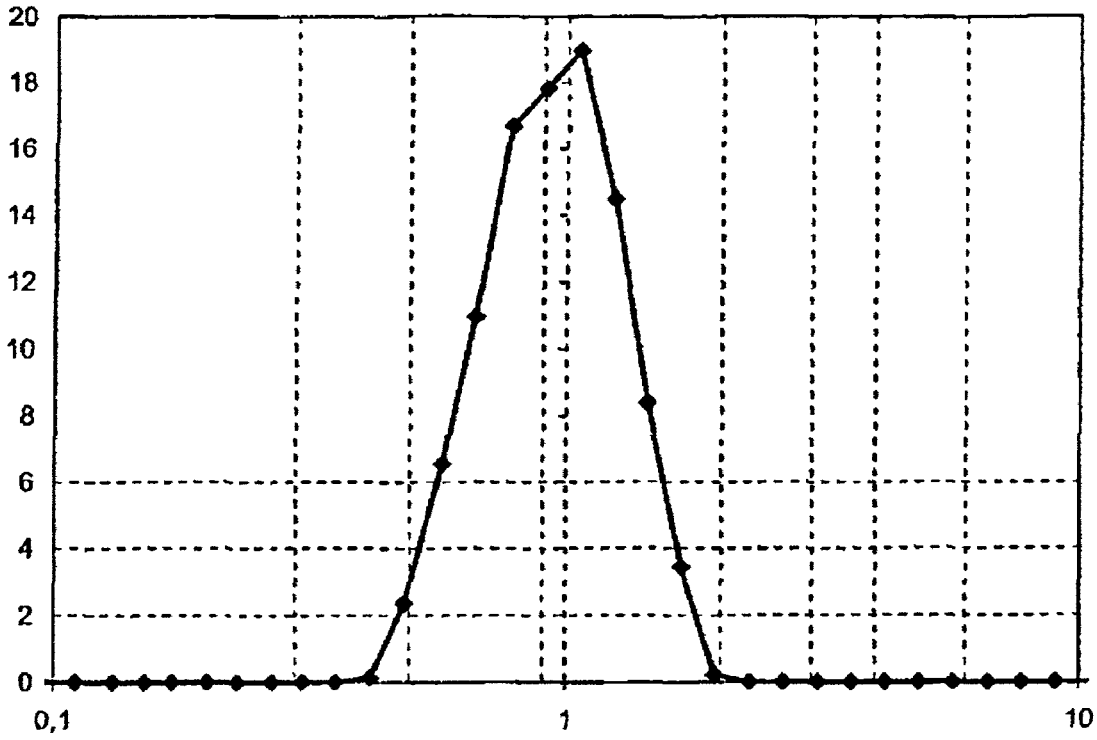

Water is added to the vessel content 300 seconds after the start of bitumen incorporation, for 50 seconds at an average flow rate of 33.1 g/s. When the water is incorporated the speed of the helical ribbon is lowered to 10 rpm in the counter-clockwise direction and the turbine speed is gradually increased up to 1600 rpm in the clockwise direction. These respective impeller speeds are maintained for 240 seconds to obtain the end product. A small quantity of so-called end emulsion is taken and diluted in a water/surfactant solution, Stabiram MS3 marketed by CECA. The very dilute emulsion thus obtained is placed in a Mastersizer S (Malvern Instruments) to measure the particle size. The particle size obtained is shown in FIG. 4.

Example 4

Calibration of the Diameter of the Emulsion Droplets

FIG. 5 shows the influence of deformation (proportional to mixing time) on the median volume diameter of the droplets in a coaxial mixing system for two separate deformation rates. The method of manufacture, the coaxial mixing system and the composition of the emulsion are those described in example 1. The dotted curve in FIG. 5 illustrates the phenomenological model developed to predict the median volume diameter in relation to deformation, for a composition of emulsion with a given disperse phase content (for a coaxial mixer). Therefore by reading FIG. 5 the skilled person is able to adapt the method to prepare an emulsion according to the invention, and in particular to adapt the parameters of mixing time and impeller rotation speed in order to prepare an emulsion whose droplets have a desired, pre-defined mean diameter.

The invention claimed is:

1. A Semi-continuous method for preparing an emulsion of droplets of a phase A in a phase B, comprising the following steps:

(i) mixing a quantity of phase A and a quantity of phase B by means of a mixing system with multiple shafts comprising at least one scraper impeller, so as to obtain a dispersion of phase A in phase B at a volume concentration of phase A of more than 74%; and wherein said phase A is added to phase B at a mass flow rate of between 0.01 time and 3 times the mass of phase B per second, (ii) diluting the dispersion obtained at step (i) by adding an additional quantity of phase B, and mixing by means of said mixing system with multiple shafts, so as to obtain an emulsion of droplets of a phase A in a phase B.

2. The method according to claim 1, wherein phase A is a hydrophilic phase and phase B is a hydrophobic phase, or wherein phase A is a hydrophobic phase and phase B is a hydrophilic phase.

3. The method according to claim 1, wherein phase A is a bitumen and phase B is an aqueous solution.

4. The method according to claim 1, wherein phase A is an aqueous solution and phase B is a bitumen.

5. The method according to claim 1, wherein the mixing system with multiple shafts also comprises at least one non-scraper impeller.

6. The method according to claim 1, wherein the mixing system with multiple shafts is coaxial.

7. The method according to claim 1, wherein the scraper impeller(s) are used at a peripheral speed equal to or less than 3 m/s.

8. The method according to claim 5, wherein the non-scraper impeller(s) are used at a peripheral speed equal to or less than 15 m/s during step (i).

9. The method according to claim 5, wherein the scraper and non-scraper impellers may operate in co-rotating or counter-rotating mode.

10. The method according to claim 5, wherein:

the mean rotating speed of the scraper impeller(s) is slower during step (ii) than during step (i); and the mean rotating speed of the non-scraper impeller(s) is faster during step (ii) than during step (i).

11. The method according to claim 1, wherein the mean diameter of the emulsion droplets is less than approximately 1 micron.

12. A Semi-continuous method for preparing an emulsion of droplets of a phase A in a phase B, comprising the following steps:

(i) mixing a quantity of phase A and a quantity of phase B by means of a mixing system with multiple shafts comprising at least one scraper impeller, so as to obtain a dispersion of phase A in phase B at a volume concentration of phase A of more than 74%; and wherein said phase B is added to phase A at a mass flow rate of between 0.0001 time and 0.1 time the mass of phase A per second, (ii) diluting the dispersion obtained at step (i) by adding an additional quantity of phase B, and mixing by means of said mixing system with multiple shafts, so as to obtain an emulsion of droplets of a phase A in a phase B.

13. The method according to claim 12, wherein the mixing system with multiple shafts also comprises at least one non-scraper impeller.

14. The method according to claim 12, wherein the mixing system with multiple shafts is coaxial.

15. The method according to claim 12, wherein the scraper impeller(s) are used at a peripheral speed equal to or less than 3 m/s.

16. The method according to claim 13, wherein the non-scraper impeller(s) are used at a peripheral speed equal to or less than 15 m/s during step (i).

17. The method according to claim 13, wherein the scraper and non-scraper impellers may operate in co-rotating or counter-rotating mode.

18. The method according to claim 13, wherein:

the mean rotating speed of the scraper impeller(s) is slower during step (ii) than during step (i); and the mean rotating speed of the non-scraper impeller(s) is faster during step (ii) than during step (i).

19. The method according to claim 12, wherein the mean diameter of the emulsion droplets is less than approximately 1 micron.

20. The method according to claim 12, wherein phase A is a hydrophilic phase and phase B is a hydrophobic phase, or wherein phase A is a hydrophobic phase and phase B is a hydrophilic phase.

21. The method according to claim 12, wherein phase A is a bitumen and phase B is an aqueous solution.

22. The method according to claim 12, wherein phase A is an aqueous solution and phase B is a bitumen.

* * * * *